United States Patent [19]

Deutsch

[11] 4,214,503

[45] Jul. 29, 1980

[54] ELECTRONIC MUSICAL INSTRUMENT WITH AUTOMATIC LOUDNESS COMPENSATION

[75] Inventor: Ralph Deutsch, Sherman Oaks, Calif.

[73] Assignee: Kawai Musical Instrument Mfg. Co., Ltd., Hamamatsu, Japan

[21] Appl. No.: 19,318

[22] Filed: Mar. 9, 1979

[51] Int. Cl.[2] ..... G10H 1/02

[52] U.S. Cl. ..... 84/1.27; 84/1.26

[58] Field of Search ..... 84/1.01, 1.03, 1.26, 84/1.27

[56] References Cited

U.S. PATENT DOCUMENTS

| | | | |
|---|---|---|---|
| 3,809,786 | 5/1974 | Deutsch | 84/1.03 |
| 3,908,504 | 9/1975 | Deutsch | 84/1.26 |
| 3,913,442 | 10/1975 | Deutsch | 84/1.26 |
| 4,079,650 | 3/1978 | Deutsch et al. | 84/1.01 |
| 4,085,644 | 4/1978 | Deutsch et al. | 84/1.03 |

*Primary Examiner*—J. V. Truhe
*Assistant Examiner*—Forester W. Isen
*Attorney, Agent, or Firm*—Christie, Parker & Hale

[57] ABSTRACT

In a musical keyboard instrument of a type having a number of tone generators substantially less than the number of keys, one of the tone generators being assigned to a key when activated, the pitch of the tone generator being set by the particular key, apparatus is provided for maintaining a constant audible loudness level to the listener from the tone generator regardless of the pitch of the tone generator. A plurality of sets of amplitude values are stored in a memory, each set including one value for each key. Each set of values corresponds to a particular loudness level. The envelope amplitude of the tone generator output is controlled to produce the same loudness level for all notes by addressing a set of values according to the selected loudness level and addressing a particular value according to which key is activated. An amplitude value is selected which is then used to control the envelope amplitude of the tone generator output signal. The amplitude value is used by the attack, decay, sustain and release amplitude generator such that the instantaneous envelope amplitude is always proportional to the selected amplitude value.

9 Claims, 7 Drawing Figures

K-VALUE MEMORY
502
K
1/K
506
505
COMPLEMENT
COMPLEMENT
1-K
1-1/K
501
STATE DECODER
S
STATE 3 OR 5
STATE 2 OR 5
DATA SELECT
507
STATE 4 OR 5
510
DATA SELECT
H
1
MULTIPLIER
MULTIPLIER
509
511
22
H OR 1
S=3,5: M(1-K)
OR
S=2,4: M(1-1/K)
ADDER
N
M
508
LEFT SHIFT
M=2^8 A^0
A0

MAIN REGISTER
340
ADDER
MULTIPLIER
SINUSOID TABLE
280
240
ADDER ACCUMULATOR
152
LOUDNESS LEVEL
SELECT
150
8=33
570
560
HARMONIC COEFFICIENT MEMORY
270
HARMONIC COEFFICIENT MEMORY
260
MEMORY ADDRESS DECODER
8
N
KEY SWITCH DETECT AND NOTE ASSIGNOR
140
87
SELECT
156
POWER NUMBER REGISTER
154
NOTE NUMBER REGISTER
100
INITIAL VALUE MEMORY
102

ELECTRONIC MUSICAL INSTRUMENT WITH AUTOMATIC LOUDNESS COMPENSATION

FIELD OF THE INVENTION

This invention relates to digital tone synthesizers, and more particularly to an ADSR generator having automatic loudness compensation control.

BACKGROUND OF THE INVENTION

It is well known that the sensitivity of the human ear varies with frequency and the loudness level of the sound. This characteristic of the human ear was recognizedby Fletcher-Munsen and is represented by a family of sensitivity curves showing sensitivity as a function of frequency with the loudness level as the family parameter. Since the pitches of the notes on an electronic organ run from a frequency of 65.4 Hz at $C_2$ to 2093 Hz at $C_7$, waveshapes of constant amplitude at the lower frequencies will sound too soft to a listener compared to the same waveshape played in the higher octaves.

Pipe organs and electronical musical instruments which have individual and independent tone generators for each note have provides sounds of scaled intensity so that the listener perceives substantially constant loudness through the full keyboard range of the instrument. This presents a problem, however, in electronic organs which include a swell pedal for controlling the sound level of the entire instrument. Such a sound level control by operating equally on all notes tends to distort the otherwise carefully scaled loudness level compensation because the shape of the compensation curve is a sensitive function of the desired loudness level. An alternative loudness scaling technique which has been employed is to use a base-boost filter inserted between the tone generator and the sound system. Typically such a base-boost filter will amplify the fundamental frequency of the lowest note $C_2$ by about 20 to 30 DB with the amplification factor tapering to unity gain for all notes above $E_3$. However, the base-boost filter introduces unequal harmonic accentuation since the filter does not amplify the harmonics of the lower notes to the same extent that the fundamental is amplified. As a result, the tonal quality of the lower notes will be distinctly different from that of the upper notes as the result of the base-boost filter. The effect on the ear is an undesirable "boomy" effect for the low notes and particularly for the pedal tones.

Another method for obtaining loudness scaling in an electronic musical instrument is described in U.S. Pat. No. 3,908,504. The method therein described is particularly applicable to a computer organ such as described in U.S. Pat. No. 3,809,786 in which the amplitudes of consecutive points on a musical waveform are computed at equal time intervals in real time. The loudness compensation is accomplished by first determining the octave or half octave of a selected note actuated on the keyboard and then scaling the computed amplitude of each point by a scale factor determined by the relative sensitivity of the human ear to the fundamental frequency of notes within the octave or half octave. However, this quantization to either 12 or 6 notes produces steps in the apparent loudness which are easily heard and can be objectionable to the listener. Moreover there is no provision for changing the loudness compensation as a function of the loudness of the instrument as controlled, for example, by a swell pedal. An additional limitation is that no provision is made for loudness compensation changes as stops are added together in combination.

The present invention is directed to an improved loudness compensation control in a polyphonic tone synthesizer of the type described in U.S. Pat. No. 4,085,644. In the polyphonic tone synthesizer, the amplitudes of a fixed number of points defining one cycle of a musical waveshape are computed and stored in a register as a master data set. These points are then read out of the register at a rate determined by the fundamental pitch of the tone being generated to a digital-to-analog converter, which converts the sequence of points in the data set to an analog voltage which changes according to the desired waveshape of the tone being generated. The number of separate tone generators is limited, for example, to 12, which is normally the maximum number of notes that can be generated at one time in response to the ten fingers applied to the keyboard plus two foot pedals. These tone generators are reassigned each time a key is released and another key actuated on the keyboard. In order to control the attack, decay, sustain, and release characteristic of each generated tone, a time-shared ADSR generator is employed to modulate the gain factor of the digital-to-analog converter of each of the tone generators. Such an envelope generator is described in U.S. Pat. No. 4,079,650. The ADSR envelope generator is time-shared by all of the twelve tone generators of the polyphonic tone systhesizer. The ADSR envelope generator computes a digital value for each tone generator which changes in value in accordance with the desired changes in amplitude of the envelope of the tone being generated. The computation of the digital value involves an iterative computation starting with an initial amplitude value from which all subsequent values are computed. This initial value is a constant which determines the relative amplitude value computed by the iterative computational process of the ADSR generator.

SUMMARY OF THE INVENTION

According to the present invention, loudness compensation is provided which avoids the problems discussed above found in prior loudness compensation controls. The loudness compensation control of the present invention is incorporated in the ADSR generator of the type described in U.S. Pat. No. 4,079,650. The ADSR generator computes periodically, on a time-shared basis, a current amplitude value for each activated tone generator of a polyphonic tone synthesizer. The stored amplitude values are utilized by the respective tone generators to set the relative peak amplitude of the tone signal being generated. The ADSR generator varies the amplitude values periodically to conform with the desired amplitude changes required to produce the attack, decay, sustain, and release envelope of the generated tones. New amplitude values are computed by the ADSR generator by an iterative process using the previously computed amplitude values. This iterative process makes each successively computed amplitude value a direct function of the initial value selected at the start of iterative computation.

A plurality of sets of initial values are stored in an initial value memory. Each set consists of one value for each key of the instrument, the values of one set being the initial values required for the ADSR generator to compute the amplitude values for a tone generator that produces constant loudness to the ear regardless of the pitch of the tone generator. By selecting different sets of values, different levels of loudness can be selected. This selection of loudness level can be by a manual switch, as operated by a swell pedal, for example, or by activation of the stop switches of the electronic keyboard instrument.

BRIEF DESCRIPTION OF THE DRAWINGS

For a better understanding of the invention reference should be made to the accompanying drawings, wherein.

DETAILED DESCRIPTION

Figure 1:
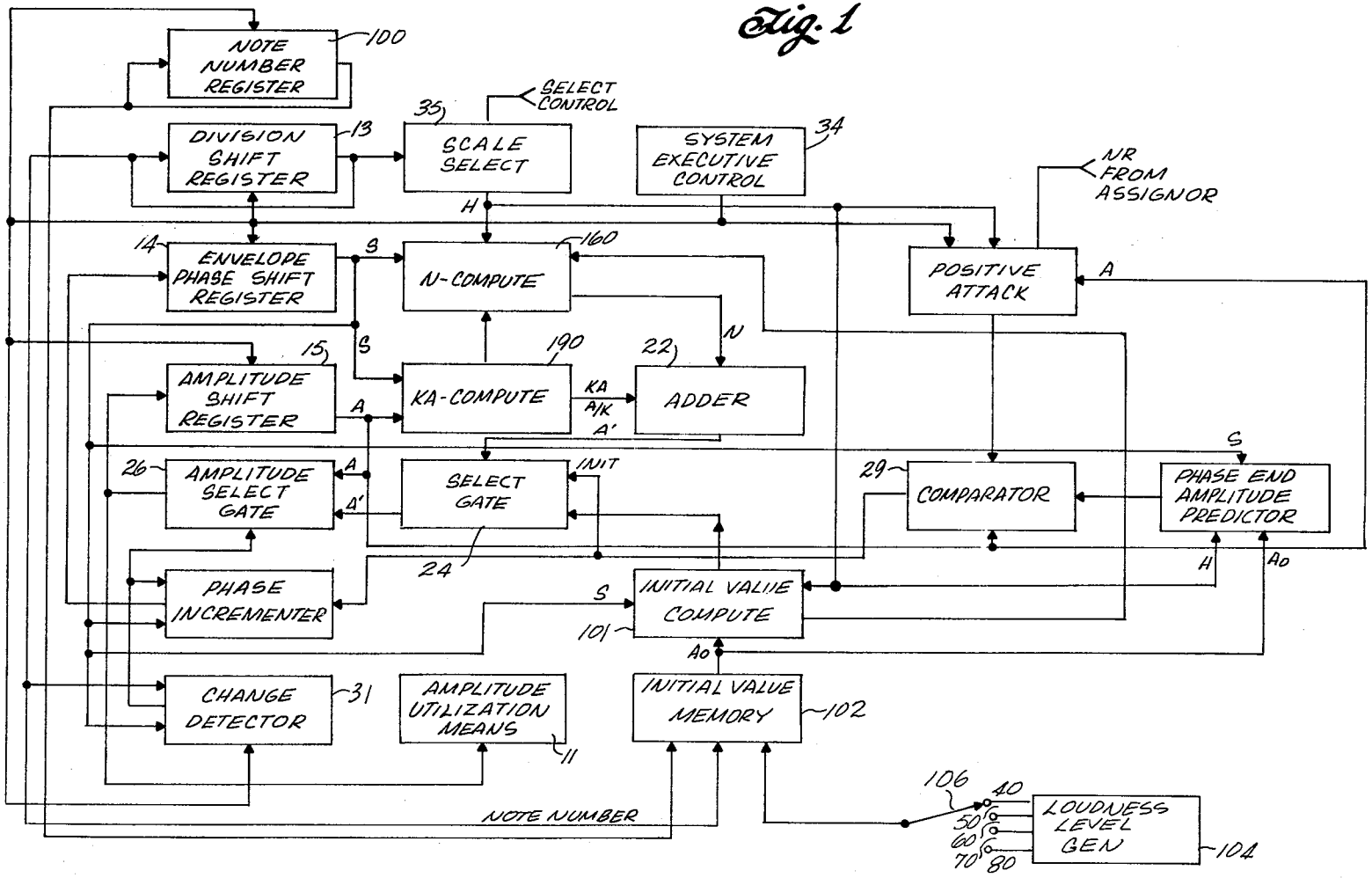
FIG. 1 is a schematic block diagram of an ADSR generator incorporating the features of the present invention.

The present invention is described in connection with FIGS. 1–7 as a modification to the ADSR envelope generator described in detail in U.S. Pat. No. 4,079,650, hereby incorporated by reference. All blocks identified by two digit reference numbers in the drawings are the same as the corresponding numbered blocks described in the referenced patent. The ADSR generator is used in association with a polyphonic tone synthesizer of the type described in U.S. Pat. No. 4,085,644, also incorporated herein by reference.

The ADSR envelope generator includes four shift registers which are shifted in unison, namely, a division shift register 13, an envelope phase shift register 14, an amplitude shift register 15, and a note number register 100. Each register stores twelve words, one word for each of the twelve tone generators. The registers 13 and 100 are loaded from the key detect and assignment circuit of the polyphonic tone synthesizer, whenever a key is depressed, with a word coded to identify the division and the note number of the particular key or pedal that is activated by the musician. The manner in which this is accomplished is described in detail in U.S. Pat. No. 4,022,098, hereby incorporated by reference. Thus the words in the registers 13 and 100 identify the notes which are currently keyed on any of the divisions of the musical instrument. The stored words associated with each tone generator are shifted out in parallel as a group from the several registers, the groups of words for the twelve tone generators being shifted out in times sequence at the logic clock rate. The registers all operated in an end-around mode so that the stored words continuously recirculate through the shift register. Although shift registers have been specifically described, it will be understood that an addressable memory could also be used to store the information, the groups of words for the twelve tone generators being addressed in timed sequence.

Each word in the amplitude shift register 15 identifies the current amplitude value A of the envelope of the audio tone being generated in response to the associated key identified by the note number and division. The value A for each tone varies with time in the manner shown by the waveform of FIG. 2. The value of A is computed for each tone generator by an iterative computing process which is hereinafter described in detail. The computational process is divided into six phases, designated S=1, S=2, - - - S=6. The current computational phase for each tone generator is stored as one of the words in the envelope phase shift register 14. The amplitude values A stored in the amplitude shift register 15 for the respective tone generators are transferred through an amplitude select gate 26 back to the input of the amplitude shift register in an end-around shift and at the same time are transferred to amplitude utilization means 11. The manner in which the amplitude information A from the register 15 of the ADSR envelope generator controls the envelope of the respective musical tones being generated by the polyphonic tone synthesizer is also described in detail in U.S. Pat. No. 4,085,644. In effect, the amplitude utilization means utilizes the current value of A for a particular tone generator to control the gain factor of the digital-to-analog converter in the associated tone generator in the polyphonic tone synthesizer, thereby amplitude modulating the instantaneous loudness level (or peak amplitude of each cycle) of the audio tone being generated.

The ADSR envelope value A for each tone generator is computed by an iterative computation according to the relation $A'=kA+N$, where A is the preceding amplitude value, A' is the newly computed amplitude value, and k and N are prespecified numbers. The values of k and N vary for each of the six computational phases. The general form of the recursive relations in each phase are as follows:

| | |
|---|---|
| Phase 1: $A' = KA + 0$ | (1) |
| Phase 2: $A' = \frac{A}{K} - \frac{M(1-K)}{K}$ | (2) |
| Phase 3: $A' = KA + M(1-K)$ | (3) |
| Phase 4: $A' = \frac{A}{K} - \frac{MH(1-K)}{K}$ | (4) |
| Phase 5: $A' = KA + MH(1-K)$ | (5) |
| Phase 6: $A' = \frac{A}{K} + 0$ | (6) |

Figure 2:
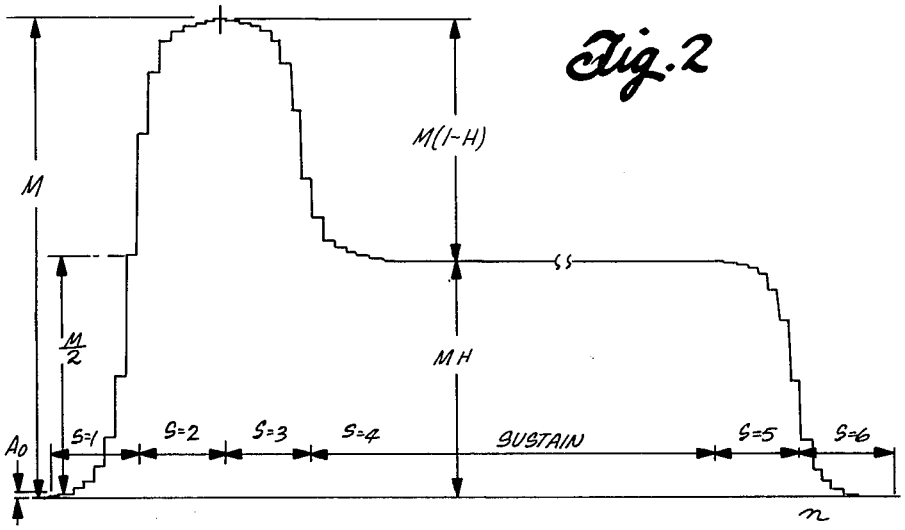
FIG. 2 is a graphical representation of the amplitude function of the ADSR generator.

Referring to FIG. 2, the waveform of the resulting envelope computed during each phase according to the above equations is shown. It can be seen that M is the maximum value of the ADSR envelope at the end of phase S=2 and is a measure of relative loudness. H is a given fractional value of M and MH is a value of the ADSR envelope during the Sustain portion of the envelope. M/2 is the value of the ADSR envelope at the end of phase S=1.

Using equation 1 above, it will be seem that at the end of the iterative computation for phase S=1

$$M/2=K^{-n}A_0 \quad (7)$$

where $A_0$ is the initial value at the start of phase S=1 and n is the number of iterative steps in phase S=1. From equation 7 it will be seen that the value of M, which is a measure of loudness, is directly proportional to the initial value $A_0$ so that the relative loudness of a tone can be controlled to achieve uniform loudness over the full range of the instrument by selecting a particular value of $A_0$ for each different note of the scale. While a number of numerical choices can be used, it has been found advantageous to select a minimum value of $A_0=1/256$ for a constant loudness level 40 on the Fletcher/Munson loudness curves and to select the corresponding maximum envelope amplitude $M=1$, thus providing a ratio of $$M/A_0=2^8 \quad (8)$$

A good choice for the number of iterative steps n per phase is about 50, which provides acceptable resolution for the ADSR steps. This yields a value of $K=1.1019$. It should be noted that if, instead of having a fixed value n for each phase, each phase is terminated when the computed value A reaches a predetermined level, then by varying the value of K in the iterative computation of A, the number of steps n, and hence the time duration of each computational phase, may be controlled in the ADSR generator. Using K to control the time per phase, rather than controlling the logic clock rate, provides a convenient way of controlling the sharpness of the attack, decay, and release characteristic of the generated tone. However, in the preferred embodiment herein described the value of K is assumed to be fixed.

The values for the relative loudness factor M to provide a constant loudness level for the notes $C_2$ through $C_7$ (note numbers 1–61) can be determined from the Fletcher-Munson loudness curves. The value of $A_0$ can then be determined from equation (7). The Fletcher-Munson constant loudness curves most useful for a musical instrument are those for loudness level 40, corresponding to very soft or the musical value pp, to a loudness level 80, which is very loud, or a musical value ff. These curves can be approximated by a second degree polynomial for the fundamental frequencies in the range of $C_2$ to $C_7$ of the musical scale. The proximating polynomial is set forth in another equation as follows:

$$DB=a_0+a_1g+a_2g^2 \quad (9)$$

where DB is the sound level for a selected note in decibels on a selected equal loudness contour and $g=\log_{10}f$, f being the fundamental frequency of the note. The coefficient values of the approximation polynomial are given by the following Table 1.

| Loudness Level | $a_0$ | $a_1$ | $a_2$ |
|---|---|---|---|
| 40 (pp) | 184.217 | −8.780 | 0.132 |
| 50 (p) | 165.549 | −7.056 | 0.016 |
| 60 (mf) | 156.097 | −6.283 | 0.103 |
| 70 (f) | 136.604 | −4.411 | 0.073 |
| 80 (ff) | 115.286 | −2.507 | 0.045 |

By calculating the DB value for a particular note on a given loudness contour using equation (9), the DB number can then be used to determine the increased value of M and $A_0$ from the minimum values of 1 and 1/256, respectively. The following two tables show the values of $A_0$ and M for each of the notes $C_2$ through $C_7$ for producing a constant loudness level 40 and a constant loudness level 80.

TABLE 2

| LOUDNESS LEVEL 40 (SOFT) | | | | | |
|---|---|---|---|---|---|
| NOTE # | INIT. VALUE $A_0 \times 256$ | AMP GAIN = M | NOTE # | INIT. VALUE $A_0$ | AMP. GAIN M |
| 1 | 0.12340045 | 31.5905 | 31 | 0.00927542 | 2.3745 |
| 2 | 0.11010142 | 28.1860 | 32 | 0.00876510 | 2.2439 |
| 3 | 0.09842392 | 25.1965 | 33 | 0.00829873 | 2.1245 |
| 4 | 0.08815358 | 22.5673 | 34 | 0.00787223 | 2.0153 |
| 5 | 0.07910626 | 20.2512 | 35 | 0.00748196 | 1.9154 |
| 6 | 0.07112353 | 18.2076 | 36 | 0.00712467 | 1.8239 |
| 7 | 0.06406891 | 16.4016 | 37 | 0.00679745 | 1.7401 |
| 8 | 0.05782463 | 14.8031 | 38 | 0.00649768 | 1.6634 |
| 9 | 0.05228896 | 13.3860 | 39 | 0.00622304 | 1.5931 |
| 10 | 0.04737386 | 12.1277 | 40 | 0.00597143 | 1.5287 |
| 11 | 0.04300302 | 11.0088 | 41 | 0.00574098 | 1.4697 |
| 12 | 0.03911027 | 10.0122 | 42 | 0.00552999 | 1.4157 |
| 13 | 0.03563808 | 9.1233 | 43 | 0.00533697 | 1.3663 |
| 14 | 0.03253638 | 8.3293 | 44 | 0.00516056 | 1.3211 |
| 15 | 0.02976157 | 7.6190 | 45 | 0.00499954 | 1.2799 |
| 16 | 0.02727557 | 6.9825 | 46 | 0.00485283 | 1.2423 |
| 17 | 0.02504515 | 6.4116 | 47 | 0.00471946 | 1.2082 |
| 18 | 0.02304118 | 5.8985 | 48 | 0.00459854 | 1.1772 |
| 19 | 0.02123819 | 5.4370 | 49 | 0.00448932 | 1.1493 |
| 20 | 0.01961381 | 5.0211 | 50 | 0.00439108 | 1.1241 |
| 21 | 0.01814838 | 4.6460 | 51 | 0.00430323 | 1.1016 |
| 22 | 0.01682463 | 4.3071 | 52 | 0.00422522 | 1.0817 |
| 23 | 0.01562732 | 4.0006 | 53 | 0.00415657 | 1.0641 |
| 24 | 0.01454304 | 3.7230 | 54 | 0.00409688 | 1.0488 |
| 25 | 0.01355993 | 3.4713 | 55 | 0.00404578 | 1.0357 |
| 26 | 0.01266751 | 3.2429 | 56 | 0.00400297 | 1.0248 |
| 27 | 0.01185650 | 3.0353 | 57 | 0.00396821 | 1.0159 |
| 28 | 0.01111868 | 2.8464 | 58 | 0.00394129 | 1.0090 |
| 29 | 0.01044677 | 2.6744 | 59 | 0.00392206 | 1.0040 |
| 30 | 0.00983426 | 2.5176 | 60 | 0.00391040 | 1.0011 |
| | | | 61 | 0.00390625 | 1.0000 |

TABLE 3

| LOUDNESS LEVEL 80 (LOUD) | | | | | |
|---|---|---|---|---|---|
| NOTE # | INIT. VALUE $A_0 \times 256$ | AMP. GAIN = M | NOTE # | INIT. VALUE $A_0$ | AMP. GAIN M |
| 1 | 0.81320934 | 208.1816 | 31 | 0.52022176 | 133.1768 |
| 2 | 0.79357982 | 203.1564 | 32 | 0.51778782 | 132.5537 |

TABLE 3-continued

| LOUDNESS LEVEL 80 (LOUD) | | | | | |
|---|---|---|---|---|---|
| NOTE # | INIT. VALUE $A_0 \times 256$ | AMP. GAIN = M | NOTE # | INIT. VALUE $A_0$ | AMP. GAIN M |
| 3 | 0.77493399 | 198.3831 | 33 | 0.51570458 | 132.0204 |
| 4 | 0.75722446 | 193.8495 | 34 | 0.51396789 | 131.5758 |
| 5 | 0.74040680 | 189.5441 | 35 | 0.51257428 | 131.2190 |
| 6 | 0.72443929 | 185.4565 | 36 | 0.51152101 | 130.9494 |
| 7 | 0.70928280 | 181.5764 | 37 | 0.51080599 | 130.7663 |
| 8 | 0.69490062 | 177.8946 | 38 | 0.51042779 | 130.6695 |
| 9 | 0.68125830 | 174.4021 | 39 | 0.51038569 | 130.6587 |
| 10 | 0.66832352 | 171.0908 | 40 | 0.51067958 | 130.7340 |
| 11 | 0.65606599 | 167.9529 | 41 | 0.51131006 | 130.8954 |
| 12 | 0.64445728 | 164.9811 | 42 | 0.51227836 | 131.1433 |
| 13 | 0.63347077 | 162.1685 | 43 | 0.51358641 | 131.4781 |
| 14 | 0.62308151 | 159.5089 | 44 | 0.51523680 | 131.9006 |
| 15 | 0.61326613 | 156.9961 | 45 | 0.51723280 | 132.4116 |
| 16 | 0.60400278 | 154.6247 | 46 | 0.51957839 | 133.0121 |
| 17 | 0.59527100 | 152.3894 | 47 | 0.52227825 | 133.7032 |
| 18 | 0.58705170 | 150.2852 | 48 | 0.52533777 | 134.4865 |
| 19 | 0.57932706 | 148.3077 | 49 | 0.52876312 | 135.3634 |
| 20 | 0.57208045 | 146.4526 | 50 | 0.53256119 | 136.3357 |
| 21 | 0.56529642 | 144.7159 | 51 | 0.53673969 | 137.4054 |
| 22 | 0.55896061 | 143.0939 | 52 | 0.54130713 | 138.5746 |
| 23 | 0.55305969 | 141.5833 | 53 | 0.54627285 | 139.8458 |
| 24 | 0.54758135 | 140.1808 | 54 | 0.55164708 | 141.2217 |
| 25 | 0.54251421 | 138.8836 | 55 | 0.55744094 | 142.7049 |
| 26 | 0.53784784 | 137.6890 | 56 | 0.56366652 | 144.2986 |
| 27 | 0.53357267 | 136.5946 | 57 | 0.57033687 | 146.0062 |
| 28 | 0.52967998 | 135.5981 | 58 | 0.57746610 | 147.8313 |
| 29 | 0.52616187 | 134.6974 | 59 | 0.58506939 | 149.7778 |
| 30 | 0.52301124 | 133.8909 | 60 | 0.59316306 | 151.8497 |
| | | | 61 | 0.60176462 | 154.0517 |

Referring again to FIG. 1, the initial value $A_0$ for each note for each of a number of different loudness levels, for example, five sets of values for the loudness levels 40, 50, 60, 70, and 80, are stored in an initial value memory 102. The value of $A_0$ in each set of stored values is addressed by the note number from the note register 100. The particular set of values is selected by a loudness level number from a loudness level generator 104. One of the five loudness level numbers 40, 50, 60, 70, and 80 is selected by a loudness control switch 106 which may be operated, for example, by the swell pedal of the instrument. The loudness level number may also be modified by the division number from the division register 13, so that the set of constant loudness values of $A_0$ may be different for different divisions of the instrument.

As described in the above-indentified U.S. Pat. No. 4,079,650 on the ADSR envelope generator, when a key is operated and a tone generator is assigned, the executive control 34 sets the phase value S in the envelope phase shift register 14 to phase S=1. This initiates the iterative computation of the amplitude value A for the corresponding tone generator as stored in the amplitude shift register 15. The initial value $A_0$ is first stored in the amplitude shift register 15 from an initial value compute circuit 101 through the select gate 24 and select gate 26, the select gates being controlled in the manner described in detail in U.S. Pat. No. 4,079,650. The initial value of A at the start of the first phase is the value $A_0$ read out of the initial value memory 102. The initial value compute circuit 101 is shown in detail in FIG. 5. If the phase value S indicates that the phase state for a particular tone generator is phase 1, as determined by a state decoder 501, a data select circuit 520 connects the initial value $A_0$ from the initial value memory 102 directly to the initial value input of the select gate 24. Thus the initial value $A_0$ is loaded in the amplitude shift register 15 at the start of phase 1 for controlling the computed values defining the amplitude curve shown in FIG. 2.

Figure 3:
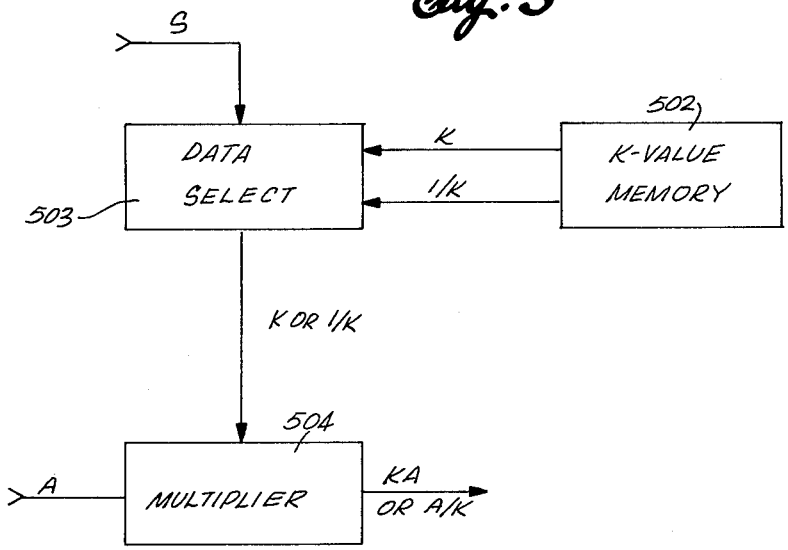
FIG. 3 is a schematic block diagram of the KA compute circuit of FIG. 1.

During each phase new values of A are sequentially computed and stored in the register 15 at time intervals controlled by the change detector 31. The new value of A is computed from the current value of A by means of an N-compute circuit 160 and KA-compute circuit 190. The N-compute circuit 160 and the KA-compute circuit 190 in combination with the adder 22 compute the new value A′ according to the equations 1 through 6, depending upon which computational phase is current. The KA-compute circuit, as shown in FIG. 3, includes a multiplier 504 which multiplies the value of A from the amplitude shift register 15 with either the value K or the value 1/K. A data select circuit 503 selects either the value K or the value 1/K from the K value memory 502, depending upon the computational phase determined by the value S. As seen in equations 1–6, the value KA is computed for phases 1, 3, and 5 and the value A/K is computed for phases 2, 4, and 6.

Figure 4:
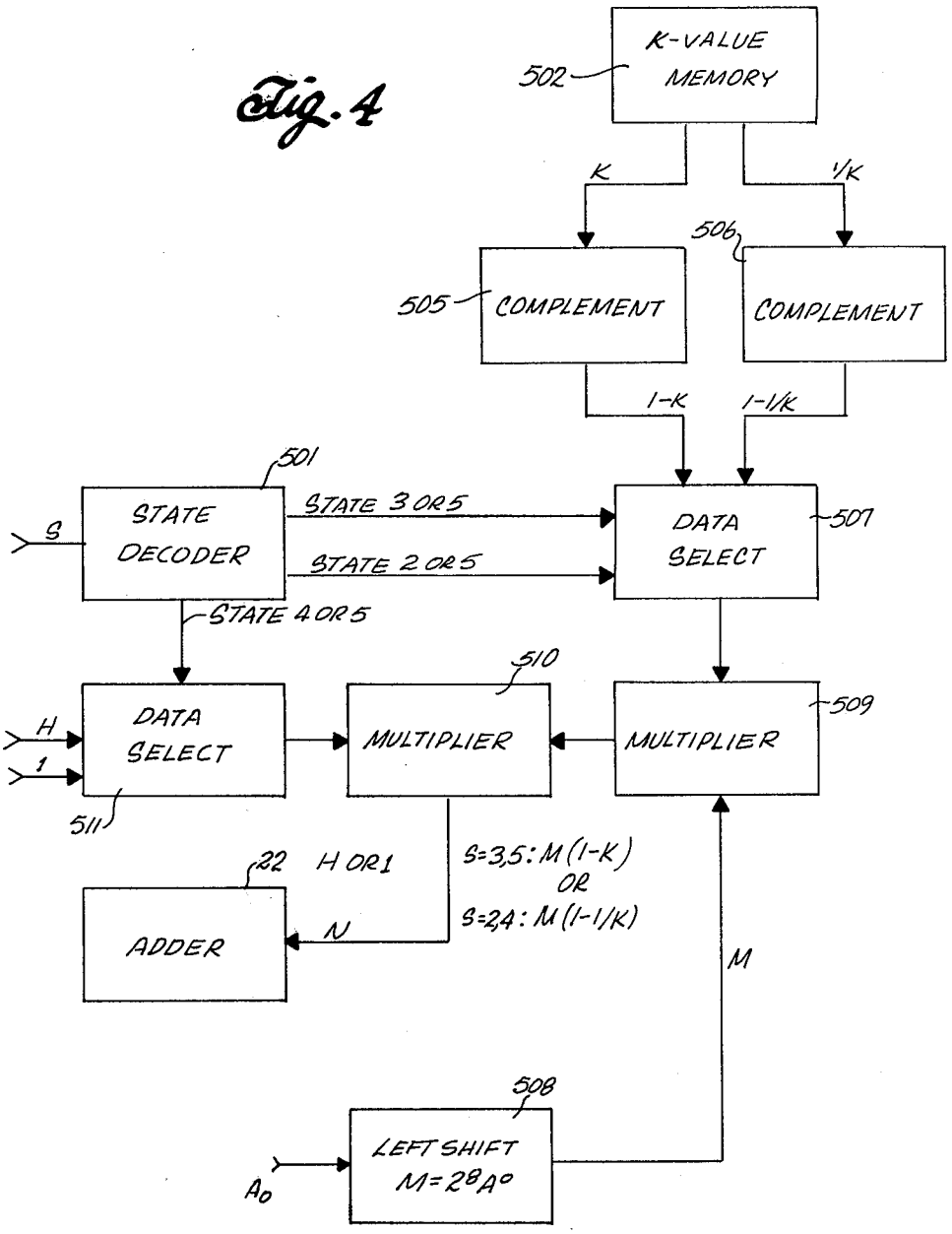
FIG. 4 is a schematic block diagram of the N compute circuit of FIG. 1.

The N-compute circuit 160 is shown in FIG. 4 to provide computation of the second term in the equations 2–5. The values from the K value memory 502 for K and 1/K are applied to complement circuits 505 and 506. Assuming the values for K and 1/K are coded in binary, the complement circuits merely change the binary zeros to ones, and the ones to zeros. The result of the complement operation in binary produces the values 1 −K and 1 −1/K. For phase states 3 or 5, a data select circuit 507 selects the value 1 −K and applies it to one input of a multiplier 509 which provides the product with the value M. M is derived from the initial value of $A_0$ from the initial value memory 102 by a left shift circuit 508 that does a left shift of 8, which is equivalent to multiplying by $2^8$ in binary. The output of the multiplier 509 is applied to a multiplier 510 which multiplies selectively the value H from the scale select 35 or unity.

A data select 511 selects H for phases S=4 or S=5, and selects 1 for the other phases.

It will be seen from the curve of FIG. 2 that the initial value at the start of phase 2 is the same as the ending value for A of phase 1. However, in phase 3 and phase 5, the initial values are a function of what value of H is selected by the scale selector 35, as given by the following relations:

$$\text{Phase 3: } A_{03}=M-MA_0(1-H) \quad (10)$$

$$\text{Phase 5: } A_{05}=MH(1-A_0) \quad (11)$$

Figure 5:
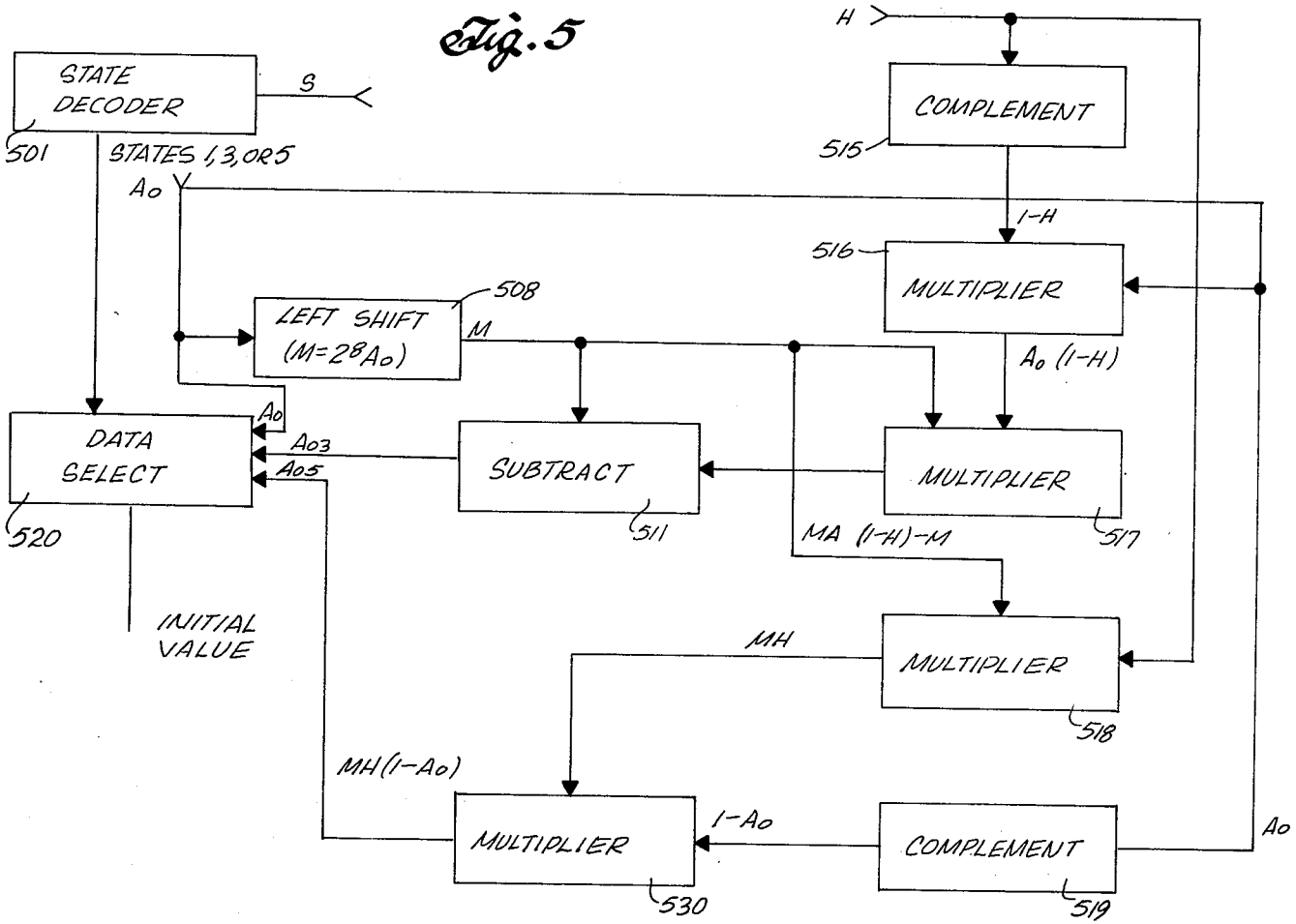
FIG. 5 is a schematic block diagram of the initial value compute circuit of FIG. 1.
Figure 6:
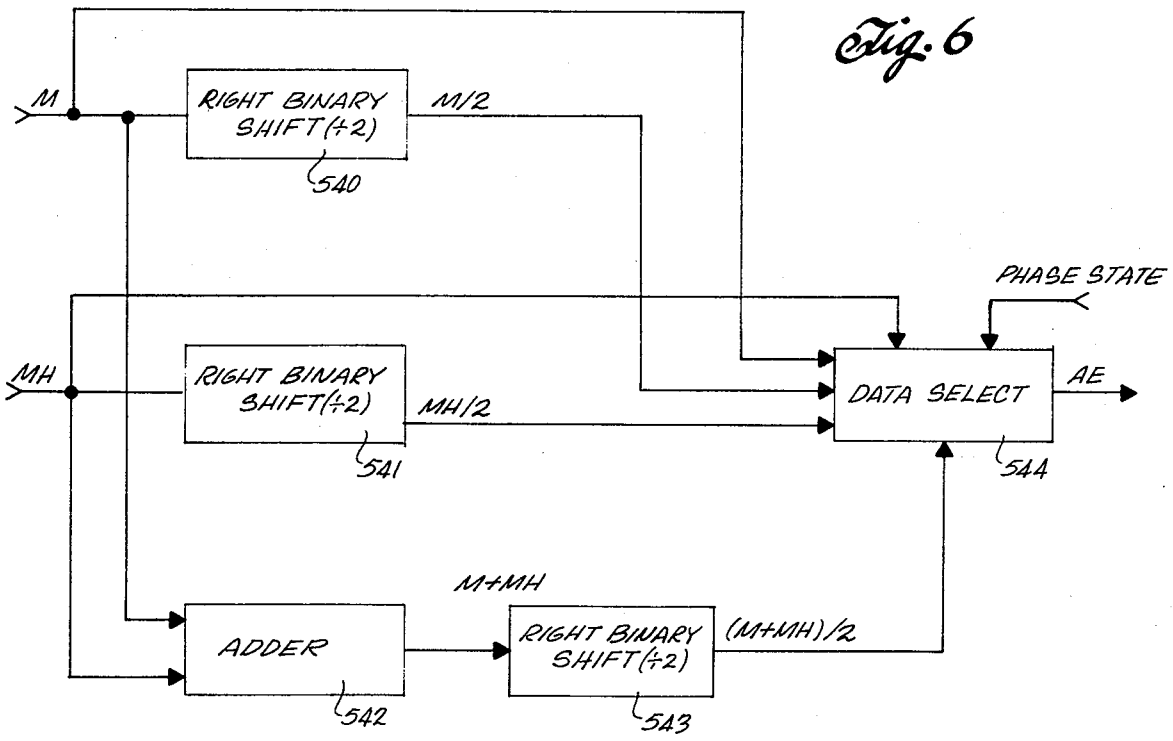
FIG. 6 is a schematic block diagram of the phase and amplitude predictor circuit of FIG. 1.

The initial value for $A_{03}$ is computed in the manner shown in FIG. 5 by first complementing the value H to obtain the value 1−H at the output of a complement circuit 515. The output of the complement circuit 515 is multiplied by the initial value $A_0$ from the initial value memory 102 by a multiplier 516, the product in turn being multiplied by the value M in a multiplier 517. M is determined by $A_0$ by a left shift of the binary value of $A_0$ of 8, that is, $M=2^8\times A_0$. The output of the multiplier 517 is subtracted from the value of M by a subtract circuit 511 to provide the initial value $A_{03}$ for phase 3 according to equation (10). A data select circuit 520 in response to the phase 3 state from the state decoder 501 selects $A_{03}$ as the initial value applied to the select gate 24.

The initial value $A_{05}$ for phase 5, the values of M and H are multiplied by a multiplier 518 and applied as one input to a multiplier 530. The value $A_0$ is complemented by a binary complement circuit 519 producing the value $1-A_0$ which is applied to the other input of the multiplier 530. The output of the multiplier 530 is the value $A_{05}$ according to equation (11). The data select circuit selects this value at the start of phase 5 of the computation.

The phase end amplitude predictor 28 of the ADSR generator described in U.S. Pat. No. 4,079,650 is modified to predict the value of A at the end of each computational phase. As seen from FIG. 2, A is approximately equal to M/2 at the end of phase 1, M at the end of phase 2, M(1+H)/2 at the end of phase 3, MH at the end of phase 4, and MH/2 at the end of phase 5. The modified phase amplitude predictor is shown in detail in FIG. 6. A data select circuit 544 selects the predicted value for the respective phases. A write binary shift circuit 540 provides the value M/2 for predicting the end of phase 1. A write binary shift circuit 541 provides the value MH/2 for predicting the end of phase 5. An adder 542 which adds the values of M and MH, is applied to a write binary shift circuit 543 for providing the value (M+MH)/2 for predicting the end of computational phase 3. The values M and MH of course are selected by the data select circuit 544 for predicting the end of phases 2 and 4, respectively.

From the above description it will be seen that a loudness control is provided in which the loudness level of each tone generator is determined by the pitch of the note by selecting an initial value from the memory 102. Merely by varying the initial value $A_0$, the envelope-defining values generated by the ADSR generator for each assigned tone generator can be scaled according to the pitch of the note in a manner that provides uniform loudness levels to the listener over the full keyboard range.

Figure 7:
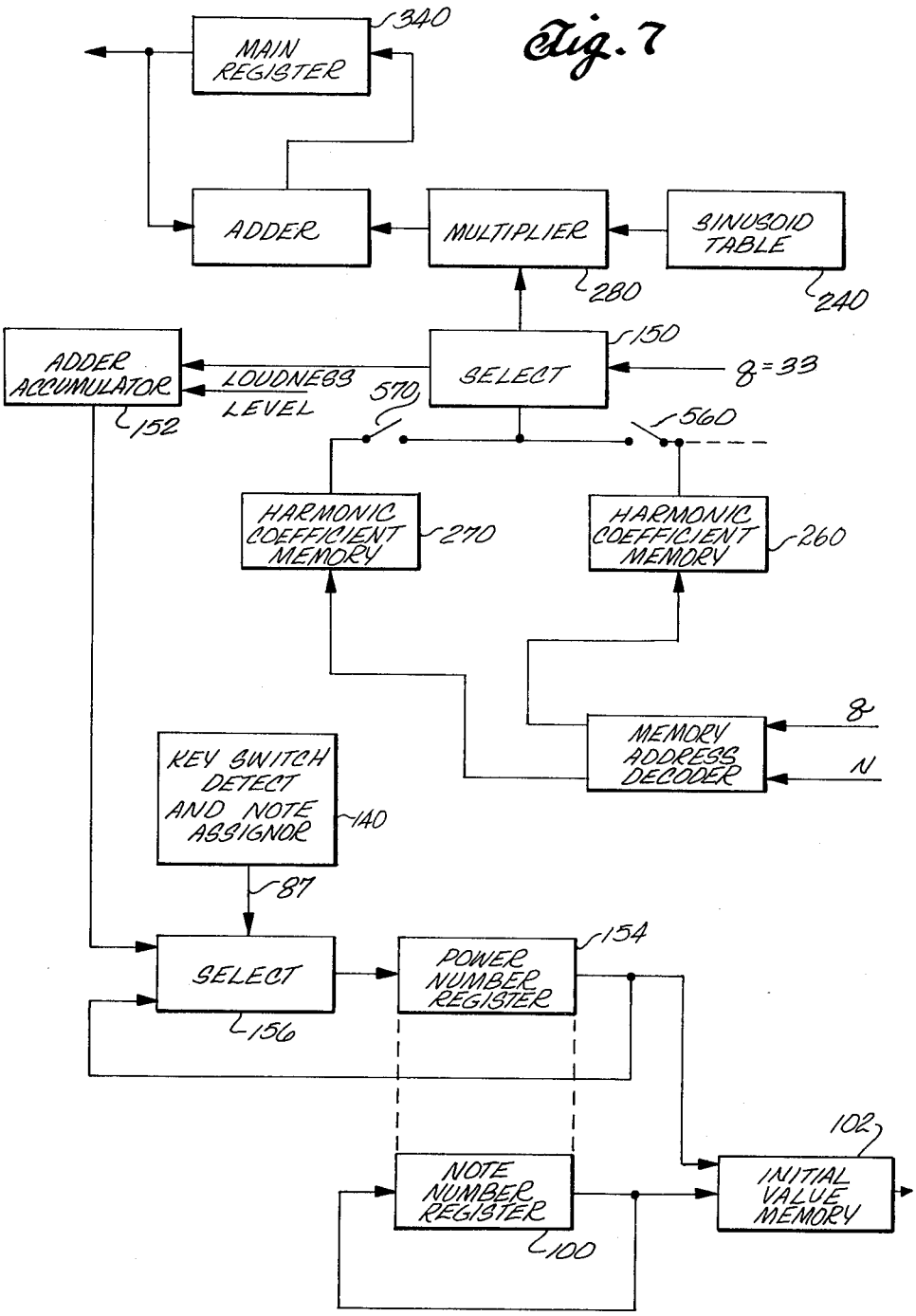
FIG. 7 is a schematic block diagram of a loudness compensation system responsive to stop settings.

While the above-described control is effective for providing full compensation where a single stop is involved, as additional stops are added the total combined tone resulting from the several stops becomes louder. The power level $P_i$ of a particular stop i can be expressed as $$P_i=\frac{1}{L}\sum_{q=1}^{q=32} C_q^2 \quad (12)$$

where $C_q$ is the coefficient for each harmonic q used in synthesizing the tone for stop i, and L is preselected normalizing constant. By computing and storing the value of P for each stop the value P for the selected stops can be combined and used to address the initial value memory 102. One arrangement for accomplishing this is shown in FIG. 7. The master data list for generating a particular tone is computed and stored in a main register 340 in the manner described in detail in U.S. Pat. No. 4,085,644 on the polyphonic tone systhesizer. As therein described, the master data list is computed by multiplying sinusoid values from a sinusoid table 240 with a set of coefficients, one for each harmonic q of the tone being generated. There is a separate set of harmonic coefficients for each stop. Thus harmonic coefficient memories 270 and 260 store the coefficients for two different stops, either or both of which are selected by stop switches 560 and 570. Additional stops may be added by additional switches and associated harmonic coefficient memories, all as described in the above-identified U.S. Pat. No. 4,085,644.

To provide the loudness compensation for different combinations of stops, according to the present invention, the value $P_i$ for each stop is stored in the associated harmonic coefficient memory. Since normally there are 32 harmonics in the polyphonic tone synthesizer system as described, the P numbers are added as a 33rd value in each of the harmonic coefficient memories. After the 32 coefficients have been addressed in sequence and applied to the input of the multiplier to be multiplied by the sinusoid values, the value of q is advanced to 33 so as to address the power number P in the respective harmonic coefficient memories. As these values are read out, a select circuit 150 in response to the q=33 condition transfers these values to an adder-accumulator 152. Since the harmonic coefficient memories of the various stops are addressed in sequence, the power number associated with each stop is added and accumulated to the power numbers of the other activated stops in the adder-accumulator 152. This number is then stored as one word in a power number register 154 through a select circuit 156 at a time controlled by the note number in the keyboard switch detect and assignor circuit 140 in the same manner that the division number associated with a particular key is stored in the division shift register 13 and the note number is stored in the note register 100. The power number register 154 stores twelve words, one for each tone generator, and is shifted in synchronism with the note number register 100 and the division shift register 13, envelope phase shift register 14, and amplitude shift register 15. The power number as read out of the power number register 154 is combined with the output of the note number register 100 and the loudness level set by the swell pedal to address the appropriate set of initial values in the initial value memory 102.

While the same family of loudness level curves computed on the basis of Table 1 may still be used in the initial value memory 102, it is desirable to add additional sets of values for $A_0$ as a function of note numbers for intermediate loudness levels which are more directly related to the values of $P_i$ for the various stops. Additional sets of initial values may be computed from the loudness coefficient polynomial of equation (9) using the coefficient relations $$a_0=238.921-1.406P_i$$

$$a_1=-13.616+0.125P_i$$

$$a_2=0.186-0.0015\ P_i$$

where $P_i \leqq 80$. L is chosen so that when all the stops are added, the sum of the values of $P_i$ for all of the stops will still be $\leqq 80$.

From the above description it will be seen that a time-shared ADSR generator for a polyphonic tone synthesizer is provided which provides loudness compensation for each generated tone. The loudness compensation provides a constant loudness level to the listener over the full keyboard range for each setting of the swell pedal and for any combination of stops.

What is claimed is:

1. An electronic musical instrument comprising: at least one tone generator for generating a musical tone, a keyboard having keys for setting the pitch and initiating a musical tone from the tone generator by operating selected keys, a memory means storing a plurality of data sets, each set comprising a plurality of data values corresponding to the relative amplitudes of points on the constant loudness level curve for the human ear over the frequency range of the instrument, there being a unique value in each set for each key on the keyboard, means including loudness controlling means for selecting one of said sets in the memory means, means responsive to operation of a key on the keyboard for selecting and reading out a corresponding one of said data values from the selected set of values, and means setting the amplitude of the tone generator output in proportion to said data value from memory, said loudness controlling means including switch means for selecting the desired loudness level of the tone generator by selecting one of said sets of values.

2. Apparatus of claim 1 wherein the tone generator comprises means including a plurality of stop switches for controlling the tonal quality of the tone generator, means associated with each of the stop switches for generating signals indicating a loudness level value for the particular stop switch, adder means adding the loudness level value signals associated with each activated stop switch, the output of said adder means being applied to said means selecting one of said sets in the memory means for selecting a particular set of values for each combination of stop switch settings.

3. Apparatus of claim 1 wherein said means setting the amplitude level of the tone generator includes an ADSR generator for modulating the amplitude of the tone generator output as a function of time in a predetermined manner, and means responsive to the data value from said memory for maintaining the instantaneous amplitude modulation level of the ADSR generator proportional to said data value.

4. Apparatus of claim 3 wherein the tone generator comprises means including a plurality of stop switches for controlling the tonal quality of the tone generator, means associated with each of the stop switches for generating signals indicating a loudness level value for the particular stop switch, adder means adding the loudness level value signals associated with each activated stop switch, the output of said adder means being applied to said means selecting one of said sets in the memory means for selecting a particular set of values for each combination of stop switch settings.

5. An electronic musical instrument comprising: a keyboard having a plurality of keys for selecting notes to be sounded, a plurality of digital tone generators which are assigned to the keys as they are activated for generating the corresponding notes, and means for controlling the amplitude envelope for each assigned tone generator to control the attack, decay, sustain, and release amplitude envelope characteristic of the resulting notes and to provide substantially equal loudness levels over the full range of the keyboard, said means including first memory means storing at least one set of initial amplitude values, the set having a unique value for each key of the keyboard, second memory means for storing an envelope amplitude value for each of the tone generators, means responsive to actuation of any selected key for reading out the associated initial amplitude value for the particular key from the first memory means and storing it as an amplitude value in the second memory means, time-shared computation means responsive to the initial amplitude value in the second memory means for periodically changing said initial amplitude value stored in the second memory means in a predetermined manner to conform with the attack, decay, sustain, and release amplitude envelope characteristic of the tone being generated, and means responsive to each computed amplitude value stored in the second memory means for controlling the envelope amplitude of the note from the associated tone generator.

6. Apparatus of claim 5 wherein said first memory means stores a plurality of sets of initial amplitude values, each set corresponding to a different constant loudness level, and loudness control means for selecting any one of said sets.

7. Apparatus of claim 5 wherein the time-shared computation means includes means for separately computing in successive computational phases the change in the envelope amplitude during the attack, during the decay, and during the release phases of the envelope characteristic, third storage means for storing a word for each tone generator identifying the current computational phase, and means responsive to the initial amplitude value read out of the first memory means and the word identifying the computational phase stored in the third storage means for a particular tone generator for computing an initial envelope value as a predetermined function of the value read out of the first memory at the start of the decay phase and release phase.

8. Apparatus of claim 6 wherein the musical instrument includes a plurality of stop switches for selecting different tone qualities of the tone generators, means associated with each stop switch for generating a relative loudness level value for the particular stop setting when the stop is set, means summing the loudness level values of each of the set stop switches, the loudness control means including means responsive to the output of the means summing the loudness level values for selecting a particular set of initial amplitude values in the first memory means as determined by the value of said output.

9. Apparatus of claim 7 wherein said time-shared computation means includes means for computing a new amplitude value A′ from a current amplitude value A stored in the second memory means according to the relation $A'=kA+N$ where k and N are constants, and means for changing the values of k and N according to the computational phase identified by the associated word in the third memory.

* * * * *